US006320554B1

(12) United States Patent
Yuanzhu

(10) Patent No.: US 6,320,554 B1
(45) Date of Patent: Nov. 20, 2001

(54) FEED HORN HAVING ELLIPTIC OPEN END

(75) Inventor: Dou Yuanzhu, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/474,704

(22) Filed: Dec. 29, 1999

(30) Foreign Application Priority Data

Jan. 6, 1999 (JP) ..... 11-000980

(51) Int. Cl.[7] ..... H01Q 13/02
(52) U.S. Cl. ..... 343/786; 343/772
(58) Field of Search ..... 343/772, 762, 343/786, 840; H01Q 13/02

(56) References Cited

U.S. PATENT DOCUMENTS 4,658,258 4/1987 Wilson .
5,486,839 * 1/1996 Rodeffer et al. ..... 343/786
5,552,797 9/1996 Cook .
5,793,335 * 8/1998 Anderson ..... 343/786

* cited by examiner

*Primary Examiner*—Don Wong
*Assistant Examiner*—Shih-Chao Chen
(74) *Attorney, Agent, or Firm*—Brinks Hofer Gilson & Lione

(57) ABSTRACT

A feed horn comprises a waveguide having an opening portion of a circular section and a horn portion having an elliptic open end and connected to the waveguide. On an inner slant peripheral surface of the horn portion are formed a plurality of elliptic grooves at radial intervals axially from a front end of the horn portion toward the waveguide, as well as a plurality of axially extending elliptic ridges partitioned by the grooves. Tip ends of the ridges are formed with a difference in height so as to approach the waveguide successively as they are positioned radially centrally. The horn portion has an elliptic tapered portion which expands in a horn shape from one axial end of the horn portion toward a front end of the elliptic open end, namely, the axial front end of the horn portion.

5 Claims, 4 Drawing Sheets

FEED HORN HAVING ELLIPTIC OPEN END

BACKGROUND OF THE INVENTION

1. Field of the Invention

The present invention relates to a feed horn for satellite broadcasting reception. Particularly, the invention is concerned with a feed horn suitable for a parabola antenna having an elliptic reflector with the major axis of the ellipse extending in the horizontal direction.

2. Description of the Prior Art

A conventional feed horn will now be described with reference to FIGS. 6 to 8. The feed horn is used in a parabola antenna 41 for the reception of satellite broadcasting signals. The receiving antenna 41 is provided with a circular reflector 42, the feed horn indicated at 43, and a reception circuit (not shown). The reflector 42 and the feed horn 43 are opposed to each other. The reflector 42 reflects a signal transmitted from a broadcasting satellite and the reflected wave from the reflector 42 is inputted to the reception circuit through the feed horn 43.

The feed horn 43 has a horn portion 44 and a cylindrical waveguide 45 connected to the horn portion 44. The horn portion 44 is provided for making it easier to pick up the reflected wave from the reflector 42 in the reception antenna 41. The horn portion 44 has an opening 46 of a circular section which is formed in a divergent horn shape from one axial end 44*a* of the horn portion toward a front end 44*b*.

The waveguide 45 is a transmission path for conducting a transmitted signal to the reception circuit, with an opening portion 45*a* of a circular section being formed in the interior of the waveguide. One end 45*b* of the opening 45*a* in the axial direction of the waveguide 45 and the axial end 44*a* of the opening portion 46 are connected together and an opposite end 45*c* in the axial direction of the waveguide 45 is connected to the reception circuit.

In the feed horn 43 constructed as above, a signal transmitted from a broadcasting satellite is reflected by the reflector 42 of the receiving antenna 41 and the reflected wave is inputted to the reception circuit via the feed horn 43.

With the recent tendency to a multi-channel satellite broadcasting, a large number of broadcasting satellites lie on the geostationary orbit and there is now a demand for improvement in directivity in the longitude direction of the receiving antenna so that a reception side of a satellite broadcasting can receive a signal transmitted from only a broadcasting satellite that transmits a desired broadcasting program from among such many broadcasting satellites.

However, in the use of the receiving antenna 41 constituted of both the circular reflector 42 and the feed horn 43 possessing a circular directivity, there is no other method than increasing the area of the circular reflector 42 for improving the directivity, thus giving rise to the problem that the cost of the antenna becomes high.

Moreover, since the feed horn 43 has the opening portion 46 of a circular section constituted of one side face portion which expands in the shape of a horn from one axial end 44*a* toward the front end 44*b* of the horn portion 44, the transmitted signal is apt to be reflected at the side face of the opening portion 46. Although this reflection can be diminished by making the inclination of the inner side face of the opening portion 46 steep, it is necessary that the distance D5 between the one axial end 44*a* and the front end 44*b* of the horn portion 44 be set long. As a result, not only the feed horn 43 becomes longer and larger in size, but also the amount of the material required for fabricating the feed horn 43 increases, thus giving rise to the problem that the cost of the feed horn 43 becomes high. Further, crosstalk is apt to occur because the electromagnetic field distribution in the opening portion 46 of the feed horn 43 is an $H_{11}$ mode distribution.

The use of an elliptic reflector may be effective as a method for reducing the area of the circular reflector 42 and improving the directivity in the longitude direction. However, if the feed horn 43 of a circular directivity shown in FIGS. 7 and 8 is combined with an elliptic reflector, the directivity of the feed horn 43 no longer matches the shape of the reflector, so that not only the reception efficiency is deteriorated but also it becomes easier to pick up noise signals from the surroundings, thus leading to deteriorated directivity of the antenna.

SUMMARY OF THE INVENTION

The present invention has been accomplished for solving the above-mentioned problems and it is an object of the invention to provide a feed horn small in size and having a high elliptic directivity and remedy crosstalk.

According to the first means adopted by the present invention for solving the above-mentioned problems there is provided a feed horn comprising a waveguide of a circular section and a horn portion, the horn portion having a base end connected to the waveguide and being expanded in a horn shape from the base end toward a front end to define an elliptic open end, wherein a plurality of elliptic ridges extending in parallel toward the open end are formed in the shape of concentric ellipses on an inner slant peripheral surface of the horn portion in such a manner that the spacing between two adjacent ridges is equal throughout the whole circumferneces of the ridges and that a virtual plane formed by connecting tip ends of the ridges is in a horn shape along the inner slant peripheral surface of the horn portion.

According to the second means adopted by the invention for solving the foregoing problems, the ridges are formed at the same height from the inner slant peripheral surface of the horn portion.

According to the third means adopted by the invention for solving the foregoing problems, the ridges are formed so that the difference in height between the tip ends of two adjacent ridges is equal with respect to all of adjacent ridges.

According to the fourth means adopted by the invention for solving the foregoing problems, the depth from an intersecting point of a straight line and an oblique line to the bottom of a groove formed by two adjacent ridges is set approximately at a quarter of the wavelength of a transmitted signal, the straight line passing through a center of the groove and parallel to an axis of the horn portion and the oblique line being obtained by connecting the tip ends of the two adjacent ridges.

According to the fifth means adopted by the invention for solving the above-mentioned problems, the horn portion is provided in a base portion thereof with a cylindrical elliptic tapered portion having one end which is circular and an opposite end which is elliptic, the cylindrical elliptic tapered portion having a length approximately half of the wavelength of a transmitted signal.

DETAILED DESCRIPTION OF A PREFERRED EMBODIMENT

Figure 1:
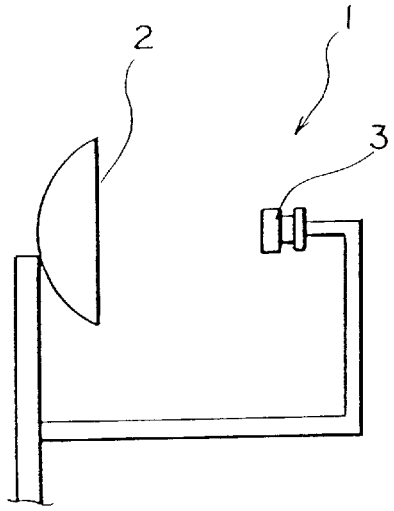
FIG. 1 is a schematic diagram of a satellite broadcast receiving antenna provided with a feed horn embodying the present invention.
Figure 2:
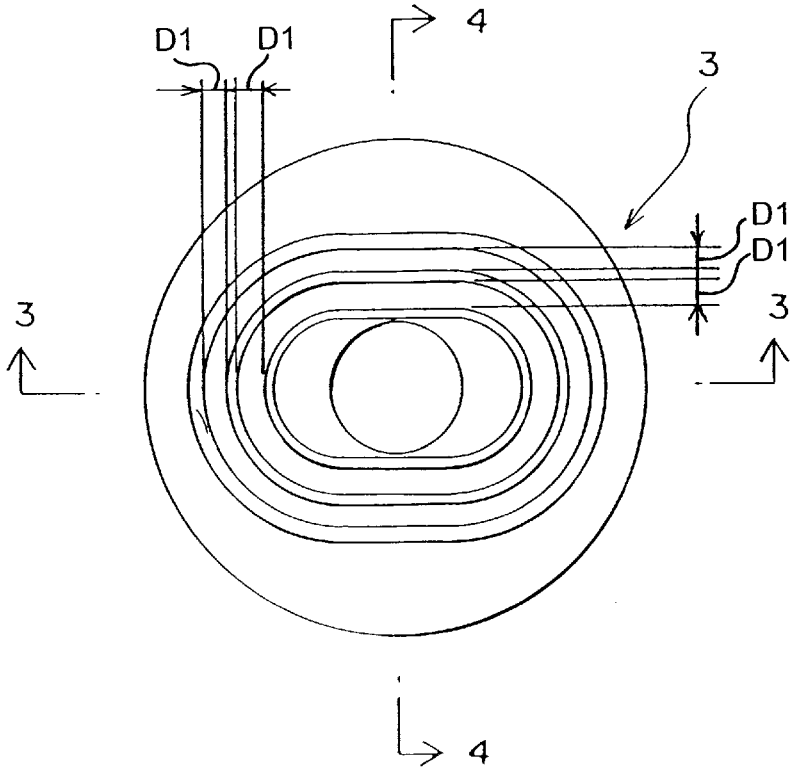
FIG. 2 is a top view of the feed horn.
Figure 3:
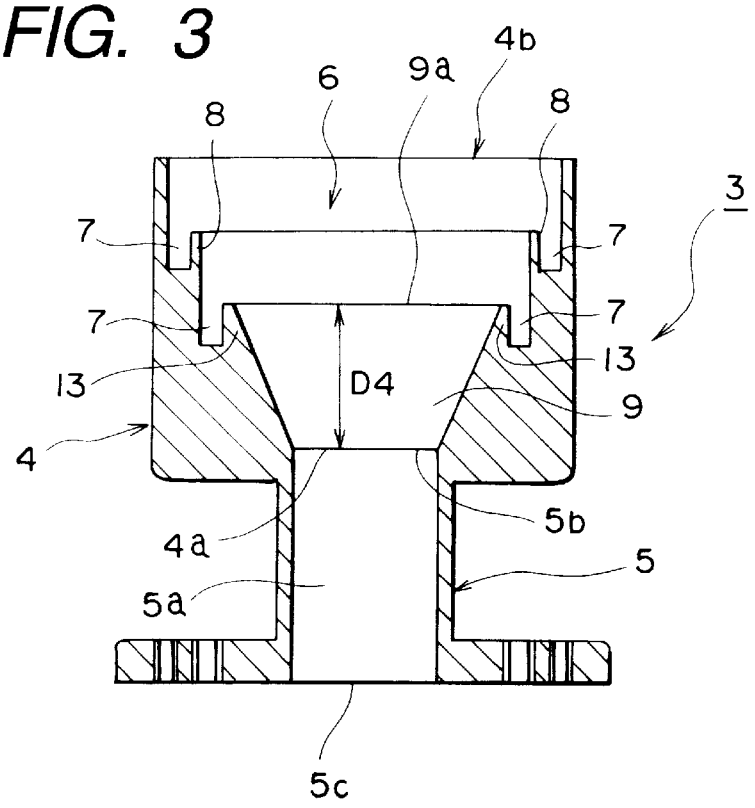
FIG. 3 is a sectional view taken on line 3—3 in FIG. 2.
Figure 4:
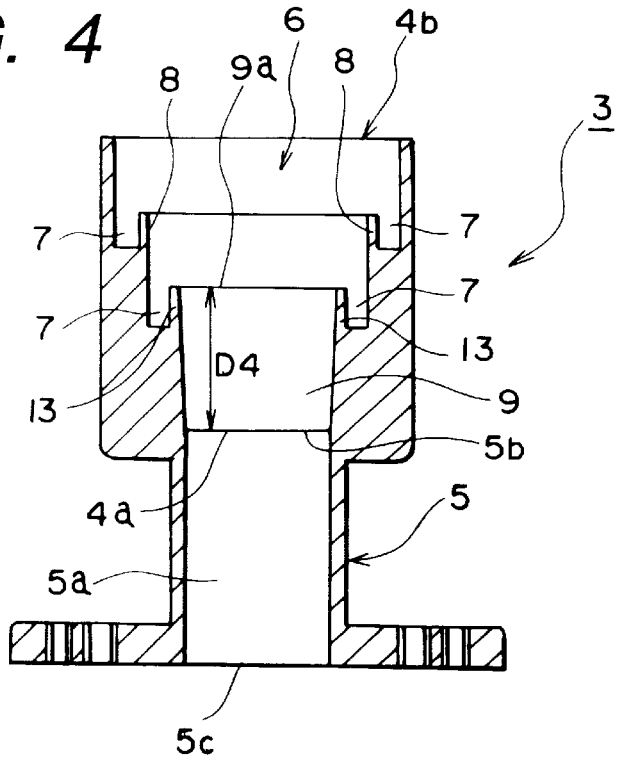
FIG. 4 is a sectional view taken on line 4—4 in FIG. 2.
Figure 5:
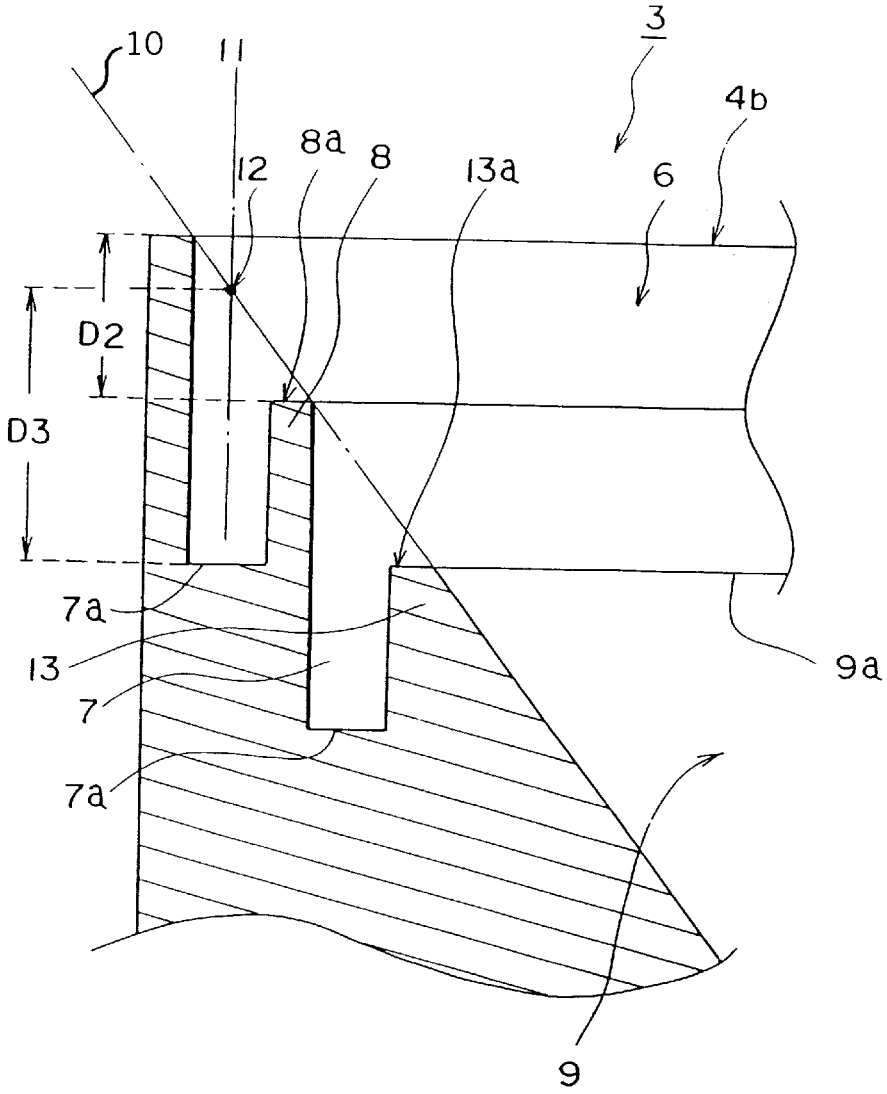
FIG. 5 is an enlarged view of a principal portion shown in FIG. 3.
Figure 6:
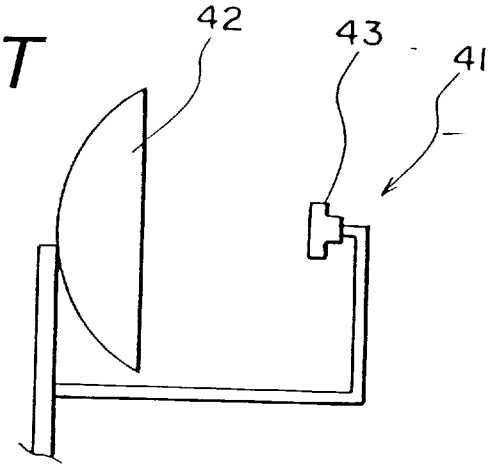
FIG. 6 PRIOR ART
FIG. 6 is a schematic diagram of a receiving antenna provided with a conventional feed horn.
Figure 7:
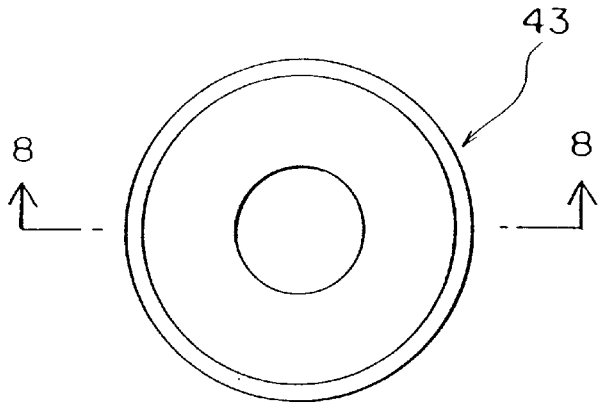
FIG. 7 PRIOR ART
FIG. 7 is a top view of the conventional feed horn.
Figure 8:
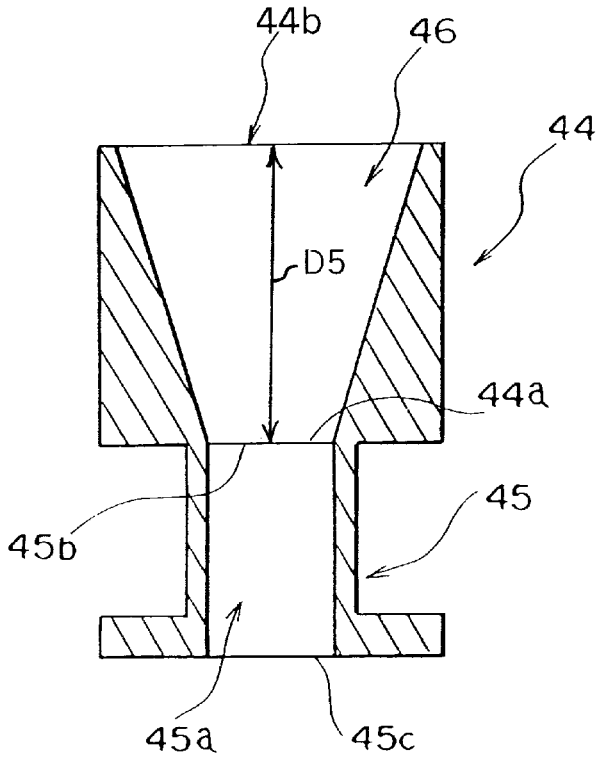
FIG. 8 PRIOR ART
FIG. 8 is a sectional view taken on line 8—8 in FIG. 7.

A feed horn embodying the present invention will be described below with reference to FIGS. 1 to 5, of which FIG. 1 schematically illustrates a satellite broadcast receiving antenna using the feed horn, FIG. 2 is a top view of the feed horn, FIG. 3 is a sectional view taken on line 3—3 in FIG. 2, FIG. 4 is a sectional view taken on line 4—4 in FIG. 2, and FIG. 5 illustrates a portion of FIG. 3 on a larger scale.

This feed horn is used in a satellite broadcast signal receiving antenna 1. The antenna 1 comprises an elliptic reflector 2, the feed horn indicated at 3, and a reception circuit (not shown), the elliptic reflector 2 and the feed horn 3 being opposed to each other. The reflector 2 reflects a signal transmitted from a broadcasting satellite and the thus-reflected wave is inputted to the reception circuit through the feed horn 3.

The feed horn 3 comprises a horn portion 4 and a cylindrical waveguide 5 connected to the horn portion. The horn portion 4, which is provided for making it easier to pick up the reflected wave from the elliptic reflector 2, has an elliptic open end 6 formed so as to expand in a horn shape from one axial end 4*a* of the horn portion 4 toward an axial front end 4*b* of the horn portion, a plurality of elliptic grooves 7 formed inside the elliptic open end 6, a plurality of ridges 8 formed in a partitioned manner by the grooves 7, and an elliptic tapered portion 9 formed so as to expand in a horn shape from one axial end 4*a* of the horn portion 4 toward the axial front end 4*b* of the horn portion.

The grooves 7, which are for diminishing crosstalk and improving the symmetry of a directional pattern, are formed axially of the horn portion 4 from the front side of the elliptic open end 6, that is, from the front end 4*b* of the horn portion, toward the waveguide 5 and elliptically at equal intervals in the radial direction of the horn portion 4 so that all the grooves are equal in radial width D1. Thus, since the grooves 7 are all equal in radial width D1, it becomes easier to design and form the grooves.

Tip ends 8*a* of the ridges 8 extend toward the front end 4*b* of the horn portion 4 and the ridges 8 are formed with a difference in height between adjacent ridges so as to approach the waveguide 5 successively as they approach the central position of the horn portion 4. The ridges 8 are formed so that the difference in height, D2, between the tip ends 8*a* of two adjacent ridges is equal with respect to all of adjacent ridges. The distance D3 between a bottom 7*a* of each groove 7 and an intersecting point 12 of lines 10 and 11 is set at a length of about a quarter of the wavelength $\lambda$ of a transmitted signal, the line 10 connecting the tip ends 8*a* of the ridges 8 formed on both sides of each groove 7, or side ends of a radial center of the horn portion 4, and the line 11 extending from a radial center of the bottom 7*a* of each groove 7 toward the front end 4*b* of the horn portion 4. Since the distance D3 is thus set at $\lambda/4$ or so, an electromagnetic field of HE mode is formed in the elliptic open end 6 of the horn portion 4, so that it is possible to improve the coincidence of directivity in a plane of polarization and also possible to diminish crosstalk.

The ellipse of the elliptic open end is not limited to a standard ellipse which satisfies the following expression 1, but may be a hyperellipse which satisfies the following expressions 2 and 3.

$$\left(\frac{x}{a}\right)^2 + \left(\frac{y}{b}\right)^2 = 1 \qquad \text{[Expression 1]}$$

$$\left[\left(\frac{x}{a}\right)^2\right]^n + \left[\left(\frac{y}{b}\right)^2\right]^n = 1 \qquad \text{[Expression 2]}$$

$$0 < n \leqq \infty \qquad \text{[Expression 3]}$$

A radial opening at one axial end 4*a* of the elliptic tapered portion 9 is circular in shape, while a radial opening at an opposite axial end 9*a* is elliptic. The longer the distance between one end 4*a* and the opposite end 9*a* of the elliptic tapered portion 9, the gentler the taper of the inner side face of the tapered portion 9, with the result that the reflection of a received signal at the inner side face is diminished. Thus, it is preferable to set the distance D4 long. But, if it is made longer than necessary, the feed horn 3 itself becomes larger in its axial length and hence becomes higher in cost.

On the other hand, if the distance D4 is set shorter than $\gamma/4$, the inclination of the elliptic tapered portion 9 becomes steep and a received signal is greatly attenuated. In view of these points the elliptic tapered portion 9 is formed so that the distance between one end 4*a* and the opposite end 9*a* is, for example, a half wavelength or so.

By the groove 7 formed at a position closest to the axis of the horn portion 4 there is formed a convex portion 13 inside the groove 7. A tip end 13*a* of the convex portion 13 corresponds to the opposite end 9*a* of the elliptic tapered portion 9.

The waveguide 5 is a transmission path for conducting a transmitted signal which has entered the horn portion 4 to the reception circuit (not shown), with an opening portion 5*a* of a circular section formed in the interior of the waveguide. One end 5*b* of the waveguide 5 and one end 4*a* of the horn portion 4 are coupled together. An opposite end 5*c* of the waveguide 5 is connected to the reception circuit (not shown).

In the feed horn of this embodiment, which is constructed as above, a transmitted signal is reflected by the elliptic reflector 2 of the receiving antenna 1 and is inputted to the reception circuit through the feed horn 3.

In the feed horn according to the present invention, as set forth above, a plurality of elliptic ridges extending in parallel toward an open end are formed concentrically on the inner slant peripheral surface of the horn portion, the spacing between two adjacent ridges is equal throughout the whole circumferences of the ridges, and a plane formed by connecting the tip ends of the ridges is in a horn shape along the inner slant peripheral surface of the horn portion. Therefore, the feed horn of the present invention possesses an elliptic directivity and is difficult to be influenced by a cross polarization, with less directivity dependence on the polarization plane.

Besides, since the spacing between two adjacent ridge, namely, the width of the groove formed therebetween, is equal throughout the whole circumferences of the ridges, the design and production are easy.

In the feed horn of the present invention, moreover, since the ridges are equal in height from the inner slant peripheral surface of the horn portion, the feed horn is difficult to be influenced by a cross polarization and hence the design and production are still easier.

Further, since the difference in height between the tip ends of two adjacent ridges is equal with respect to all of adjacent ridges, a received signal is little reflected in the horn portion.

Further, since the depth from an intersecting point of a straight line and an oblique line to the bottom of each groove defined by two adjacent ridges is set at approximately a quarter of the wavelength of a transmitted signal, the straight line extending through the center of the groove and parallel to the axis of the horn portion, the oblique line connecting the tip ends of the two adjacent ridges, an electromagnetic field of HE mode is formed in the opening portion of the horn, so that the directivity is improved and crosstalk is susceptible to occur.

Additionally, since an elliptic tapered portion having one circular end and an elliptic opposite end and having a length of approximately half of the wavelength of a transmitted signal is formed in the base portion of the horn portion, the connection between the horn portion and the waveguide, which are of different shapes, is easy and a received signal is little attenuated at the elliptic tapered portion.

What is claimed is:

1. A feed horn comprising a waveguide of a circular section and a horn portion, said horn portion having a base end connected to said waveguide and being expanded in a horn shape from said base end toward a front end to define an elliptic open end, the base end being provided with a cylindrical elliptic tapered portion having one end forming a circular shape and an opposite end forming a elliptic shape, wherein a plurality of elliptic ridges extending in parallel toward said open end are formed in the shape of concentric ellipses on an inner slant peripheral surface of said horn portion in such a manner that the spacing between two adjacent said ridges is equal throughout the whole circumferences of the ridges and that a virtual plane formed by connecting tip ends of said ridges is in a horn shape along the inner slant peripheral surface of said horn portion.

2. The feed horn according to claim 1, wherein said ridges are formed at the same height from the inner slant peripheral surface of said horn portion.

3. The feed horn according to claim 1, wherein said ridges are formed so that the difference in height between the tip ends of two adjacent said ridges is equal with respect to all of adjacent said ridges.

4. The feed horn according to claim 1, wherein the depth from an intersecting point of a straight line and an oblique line to the bottom of a groove formed by two adjacent said ridges is set approximately at a quarter of the wavelength of a transmitted signal, said straight line passing through a center of said groove and parallel to an axis of said horn portion, and said oblique line being obtained by connecting the tip ends of the two adjacent ridges.

5. The feed horn according to claim 1, wherein said cylindrical elliptic tapered portion has a length approximately half of the wavelength of a transmitted signal.

* * * * *